United States Patent [19]

Westfall

[11] 4,377,125

[45] Mar. 22, 1983

[54] SWING SPEED ANALYZER

[76] Inventor: Leonard J. Westfall, 5848 Gareau Dr., North Olmsted, Ohio 44070

[21] Appl. No.: 273,574

[22] Filed: Jun. 15, 1981

[51] Int. Cl.[3] ..... A63B 69/36

[52] U.S. Cl. ..... 116/67 R; 73/493; 116/74; 273/186 A

[58] Field of Search ..... 73/491, 493, 494, 535; 116/67 R, 74; 273/183 R, 183 D, 186 R, 186 A, 186 C, 26 B

[56] References Cited

U.S. PATENT DOCUMENTS

| | | | |
|---|---|---|---|
| 2,780,098 | 2/1957 | Maroth | 273/26 B |
| 3,575,419 | 4/1971 | Davis | 273/186 A |
| 3,601,081 | 8/1971 | Smith et al. | 73/492 |

*Primary Examiner*—James J. Gill

*Attorney, Agent, or Firm*—Baldwin, Egan, Walling & Fetzer

[57] ABSTRACT

A training or practice device especially designed for use on athletic club type of equipment such as a golf club, tennis racket, baseball bat or the like which is swung to strike a game ball during normal game use and which device is releasably attached to the club, racket or bat and operable to provide an audible and visual indication when the swing of said equipment is proper. The device includes an element that is actuatable to give an audible and visual indication when the swing of the club type equipment has the optimum velocity and power for striking the game ball. The element is manually resettable after each swing of the equipment for subsequent and repeatable use of said equipment whereby the user, by practice, may repeatedly obtain the optimum velocity and power on each swing of the equipment.

9 Claims, 9 Drawing Figures

SWING SPEED ANALYZER

DESCRIPTION

1. Field of the Invention

The invention described here is a method and device to indicate the relative velocity of any instrument that is swung. The preferred instrument is a golf club, but the invention could also be applied to a baseball bat or a tennis racket or raquet ball racket.

This invention is intended to cover all the areas where a club of any type is swung with the purpose of achieving maximum club speed with good control. The device and the method of using the device is intended to be an aid in teaching the swinger of the club the principles necessary to swing the club properly. The size and convenience of the device allows the swinger of the club to use the device in all outdoor situations on the golf course and on the practice area. This flexibility greatly increases the usefulness of the device.

2. Background Art

As one preferred embodiment the present invention as illustrated herein is designed for use with a golf club, although other instruments that are adapted to be swung could be used.

One of the major problems of golfers is their inability to swing the golf club with good timing and power. These two areas do not seem to work together in a coordinated fashion. Usually the golfer will try to swing with power and will have very poor coordination and timing or he will try to swing with good coordination and timing but his strong side will tend to dominate the swing.

Many books have been written to teach golfers the proper golf swing but they are usually unable to transmit much information to the golfer by the printed word. The best way to teach a golfer the proper golf swing is to somehow get him to first make one or several good golf swings so that he can experience the feeling of a good golf swing. Once the golfer experiences this feeling of a good golf swing he will find it much easier to understand the golf theory explained in the many golf books and articles. Also, he will be able to reproduce that good golf swing and feel with some knowledge and experience. Unfortunately for most golfers, the only way they can conveniently produce a good golf swing is to go to a teaching golf professional for instruction. This method of learning a good golf swing is expensive and time consuming and not appealing to the majority of golfers. They typically do not have the time or the energy to practice for long hours at their golf swing and consequently become saddled with a poor golf swing for most of their life. My invention and method of training with the invention greatly increase the individual golfer's ability to experience a good golf swing and maintain this swing on the golf course and consequently to more consistently reproduce a good golf swing.

Another area in golf or other activities that causes problems is the inability of the golfer to properly warm up before a round of golf. The typical golfer usually takes several swings with his driver or with several irons before he hits the first golf ball of the round. It is very common under these conditions to play poorly until enough golf balls are hit to enable the golfer to start playing well. My invention may be used as a very effective warm-up device to indicate that the swing is well timed which will allow the golfer to play well from the first tee.

A third area which causes many problems is the inability of the golfer to retain his golf swing timing on the golf course once it is lost and several bad shots have been hit. My invention may be used to solve this problem by using the invention on the golfer's own golf club while on the golf course. Several swings of the golfer's own club, with my invention attached, will enable the golfer to regain his timing quickly.

These three areas: (1) a golf swing teaching aid, (2) a golf warm-up device, and (3) a golf swing timing device for use on the golf course, constitute the major areas that my invention may be used to the great advantage of the average golfer.

Many devices have been built to attempt to solve these problems but none of them has a great impact on the majority of golfers. A device of this type is shown in U.S. Pat. No. 3,575,419. As can be seen, this device is a practice club that is only suitable for those who like to practice. Also the club is heavy and very inconvenient to use while on the golf course. The device being disclosed in this patent application is a great improvement over existing equipment and is designed to be used by the serious golfer, who enjoys practicing, and the casual golfer who would only use the device to warm up before a round of golf. The portable nature of this invention makes it significantly different and allows every golf club in the golfer's bag to be a practice club.

BRIEF SUMMARY

It is therefore one objective of this invention to provide a small and portable device that may be attached to a golf club, or any other club that is swung, which will enable the user of the club to determine the relative velocity of his club head.

It is another objective of this invention to enable the device of this invention to be easily adjustable in order to be useable by anyone able to swing a club.

It is another objective of this invention to have the device of the invention attached quickly and conveniently to any golf club or any other club or bat or racquet.

The object of the invention is to use centrifugal force created by the velocity of the swung club to force a movable metal object to overcome an adjustable resistance. As the movable object overcomes the adjustable resistance it is directed by centrifugal force to move away from the golfer at a high velocity. By stopping the movable object with a metal stop a loud audible sound is created at impact. The device of the invention has been designed to make the sound produced by two impacting metals to be very loud. The loudness of the sound at impact is very important because it enables the weight of the movable object to be reduced greatly while still maintaining a sufficiently loud sound at impact. This fact is very important and distinguishes this invention from other devices which are large and not convenient to use in most golfing situations. The design of this device is significantly superior over existing devices so as to enable the device to be made quite small and extremely portable. The portability of the device greatly enhances its application, acceptance and usefulness to the general public.

A further object of this invention is to design the device to allow it to be made small enough to fit into and be carried within a shirt or pants pocket. The compact nature of the invention allows the device to be used at any time by simply removing the device from the golfer's pocket and easily attaching it onto the golf club of the golfer's choice. The preferred golf club is the driver or 3-wood which most golfers would use for golf tee-shots.

DESCRIPTION OF THE PREFERRED EMBODIMENT

Figure 1:
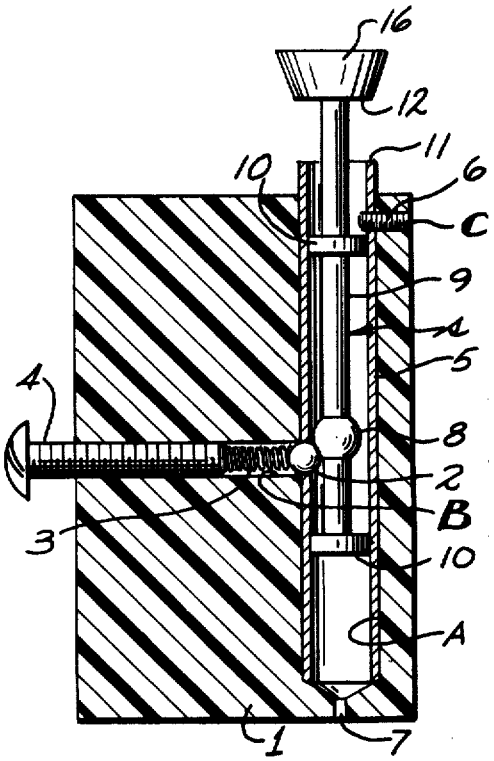
FIG. 1 is the preferred embodiment of the invention.
Figure 2:
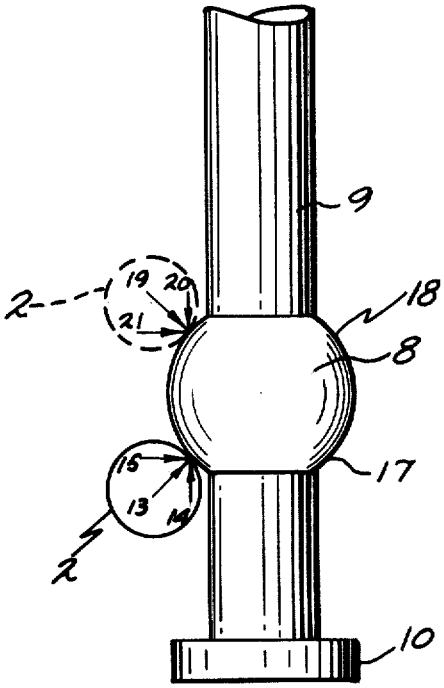
FIG. 2 is a closeup view of a portion of the movable object of the embodiment of FIG. 1 with the forces exerted on the movable object illustrated.

Referring to FIG. 1, the invention consists of a small body 1, made of plastic or any other suitable material. The body is fabricated with several holes. A hold A is drilled in the long dimension of the body and a metal tube 5 is placed in the hole and secured with glue. Two holes B and C of different size are formed into the side of the body and are threaded to accept the appropriate screws. In the large hole B is placed a steel ball 2 only slightly smaller than the hole. On top of the ball is placed a strong spring 3 capable of exerting significant force when compressed. Behind the spring is a short fine threaded screw 4 used for adjusting the compression force on the spring and ball. The other hole C is formed to accept a small set screw 6 which is used to retain the movable weight 9 inside the tube. The length of the metal tube is slightly longer than the plastic body so that a small portion of the tube protrudes above the top of the body creating a striking surface 11. At the bottom of the tube is located a small hole 7 which allows any compressed air to escape and allows excess lubricant to drain out. Inside the metal tube is placed the movable metal object or weight 9 that is acted on by centrifugal force to move downward inside the metal tube. The movable object or weight 9 is composed of a centrally located shaft having three principle features attached to or part of it. First, bearing rings 10 disposed on opposite ends of the shaft are used to stabilize the central shaft while allowing only a minimum of contact and friction against the side walls of the tube. Second, a resistance ring 8 bulbous-like in configuration is located on the central shaft to engage the steel ball 2. Third, on the top of the central shaft is located a metal cap 16 with striking surface 12 which makes contact with striking surface 11 of the metal tube. A significant aspect of this invention is the fact that the striking surfaces are located outside of the body 1 thereby allowing the sound caused by the metal to metal impact to be heard at its loudest. Referring to FIG. 2, the resistance ring 8 is designed in such a way as to cause a much larger striking force to be created than would be created by centrifugal force acting alone. This results in a higher velocity and a louder sound at impact of the two striking surfaces. Now centrifugal force is related to club velocity by the relationship $$F = M\,V(2)/r$$

where

F = Centrifugal force

V(2) = velocity squared

M = the mass of the movable object r = the length of the golfer's arm and the golf club.

Therefore, centrifugal force increases as the square of the velocity of the golf club head. As the club is swung with the invention attached, centrifugal force causes the steel ball 2 to move up surface 17 of the resistance ring which causes the compression of the spring 3. The action of the steel ball on surface 17 causes a normal force 13 on the resistance ring. This force has two components, forces 14 and 15. Force 14 is in the opposite direction as the centrifugal force created by the club head velocity. Force 15 is the force caused by the compressed spring 3. When the centrifugal force is large enough to overcome force 14, the spring force 15 is also overcome and the ball moves from side 17 and over to side 18. This action causes the steel ball to rise into the hole above. Now the steel ball rolls down side 18 of the resistance ring as the movable metal object moves past the ball. At this point the shape of the resistance ring 8, while in contact with the steel ball 2, causes the compression force in the spring 3 to act on the resistance ring as 19. This force is normal to the contact surface and has two components, one vertical 20 and one horizontal 21. It is obvious that force 20 is equal in magnitude and opposite in direction to force 14 which was slightly less than the centrifugal force. These forces are both related to the spring compression force. Since force 20 is in the same direction as the centrifugal force and almost equal to the centrifugal force in magnitude, the two forces are additive and the movable object is forced to move at a much higher velocity and thereby create a louder sound upon impact of the striking surfaces than would be created by centrifugal force alone.

Another advantage of this design is the reduced friction force acting on the movable metal object as the steel ball moves past and along the length of the moving object. In this design the spring force acting on the steel ball is much lower since the spring is not in the fully compressed state after the largest diameter of the resistance ring moves past the steel ball and the spring force is quite low while the steel ball is moving along the small diameter of the movable object. The reduced spring force lowers the force of friction of the steel ball on the movable metal object and also reduces the force of friction of the movable metal object against the side walls of the metal tube. The total reduction of friction force results in less resistance to the downward motion of the movable object and consequently results in a higher velocity of the movable object. This fact produces a larger force at impact which results in a louder impact sound of the two striking metal surfaces.

The design of this invention, namely (1) to minimize friction surfaces, (2) to reduce the force that the steel ball exerts on the movable object in the area past the resistance ring 8, (3) to locate the striking surfaces outside of the body of the device and, (4) the design of the resistance ring 8 to allow the steel ball and the spring to both resist the motion of the movable object and help with the motion of the movable object with an equal and opposite force that caused the initial resistance, has given the inventor the ability to make the device very small. The smallness of the device together with a quick attachment mechanism make the invention very useful to the average golfer. This device would be used by the average golfer as a biofeedback device. It will send back information to the golfer on the quality of every golf swing taken with the invention attached to the golfer's club.

Most golfers are unable to swing with power and good timing at the same time. Either they swing with power and poor timing or they swing with good timing and very little power. Both situations result in low club head velocity. By using the invention on the golfer's driver he can now swing the driver and receive information about the velocity of his club head. The information is received in two ways. First the movable object gets depressed by the centrifugal force the club head created which results in a loud click and a visual depression of the metal cap 16 for those who have poor hearing. The depression of the metal cap 16 tells the golfer that the swing velocity was sufficient to overcome the force applied by the adjustable spring 3. Second, the movable object does not get depressed which is noted by the lack of a loud click and by the metal cap 16 sticking out of the device for those who cannot hear. This information can be very useful for those who are trying to increase their club head speed or for those who are trying to maintain a consistently high club head speed.

The golfer's club head speed can be increased by trying to swing the golf club at increasingly higher spring tensions. The golfer will quickly learn to do what is necessary to make the movable object click and will reach an adjustable spring tension setting that represents the golfer's best swing. If the golfer is able to practice with the invention on his own golf clubs, he will find that he is able to swing with increased velocity as indicated by increased spring tension settings. This increased velocity can only be achieved by a combination of power and good timing. It is the inventor's experience that the improved golf swing translates directly to an improved striking of the golf ball. This invention can also be used very effectively as a warm-up device. By using the invention on the golfer's driver before a round of golf and by gradually increasing the spring tension until the predetermined point of maximum spring tension is reached, the golfer has reached his maximum golf club velocity or has warmed up very well before the first golf ball is struck. On an average this warm-up technique could save most golfer's two to three strokes per nine holes of golf. This invention can also be used while on the golf course by keeping the spring tension at or very close to the maximum setting. The golf club, with the invention quickly attached, can be swung several times until the device makes an audible click at a predetermined setting. This technique will maintain good swing timing throughout the round of golf or it will return good timing to the golfer in the event that several poor golf swings have been made. It must be remembered that only the golfer's best swing will depress the movable object and not a poor swing, assuming that the device is set at or very close to the golfer's highest setting of the adjustable screw 4.

Figure 3:
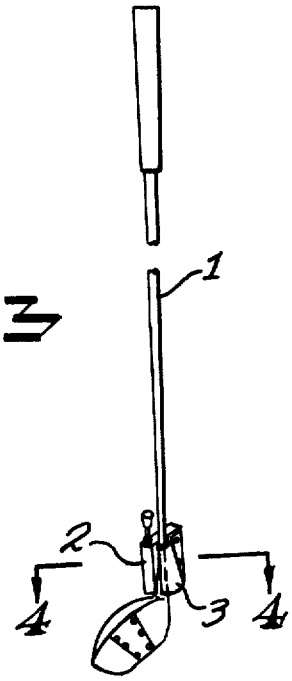
FIG. 3 is an elevational view showing the present device attached to a golf club.
Figure 4:
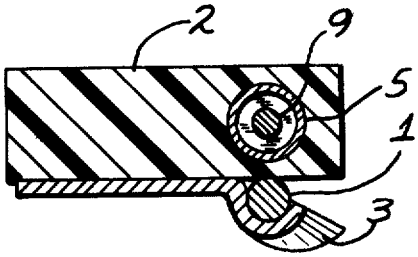
FIG. 4A is a partial sectional view taken on line 4A—4A of FIG. 3.
FIG. 4B is an elevational view of the clamping device for attaching the swing analyzer of FIG. 1 to the golf club shaft.
Figure 4A:
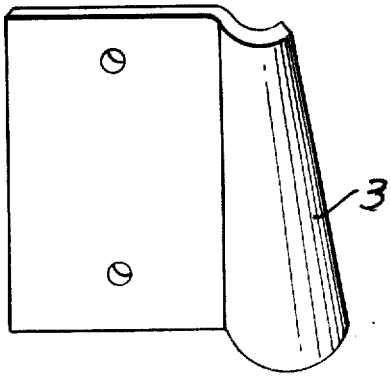

The small portable nature of the invention as shown in FIG. 1 may be attached to a golf club as a driver by a suitable clamping mechanism. Such a mechanism is shown in FIGS. 3 and 4. FIG. 3 depicts a driver 1 with the swing speed analyzer 2 attached to the golf club by a clamping mechanism 3. The clamp will preferably be a tapered section of moldable plastic which will be shaped to fit the contour of the tapered hose 1 of a typical wood headed golf club. Although the swing speed analyzer can easily be attached to an iron headed golf club as well, by the use of a slightly different clamping device. FIG. 4 is a closeup view of the tapered clamping device to be used on wood headed golf clubs.

Figure 5:
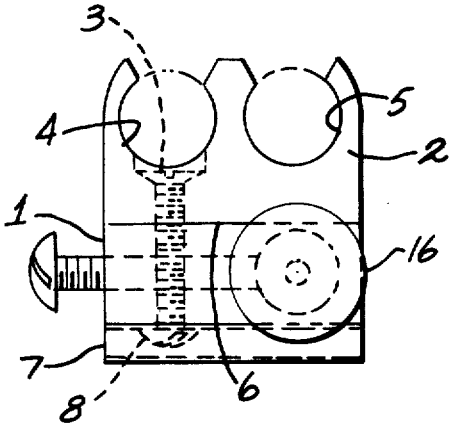
FIGS. 5–8 are views of a second embodiment of the present invention.
Figure 6:
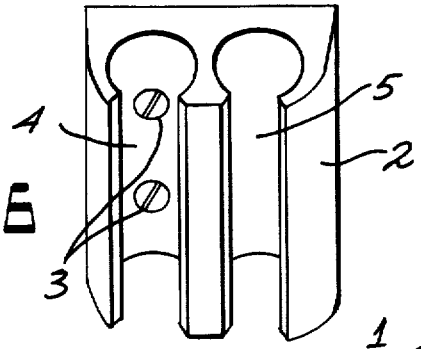

FIGS. 5 and 6 show another clamping device. In these figures the body of the invention is 1 and is attached to a double channeled snap 2 by suitable screws 3. The snap 2 may be attached by applying a suitable adhesive at surface 6. The snap has two channels, one for the typical drive shaft 4 of 0.335 inch and the other channel for the typical iron shaft 5 of 0.370 inch. These dimensions may be changed to fit different diameter golf shafts. The snap 2 may be made out of nylon or other materials that are resilient enough to firmly hold onto the golf shaft while the golf club is swung.

Figure 7:
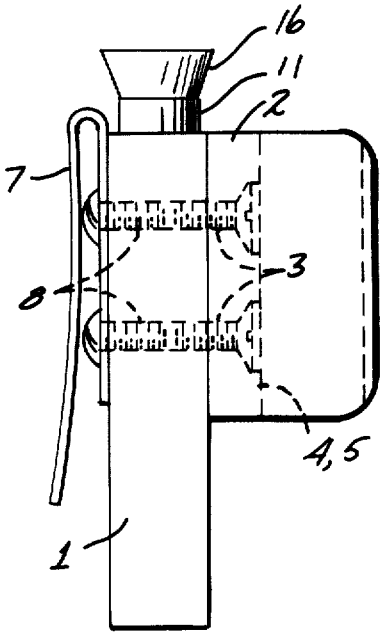
Figure 8:
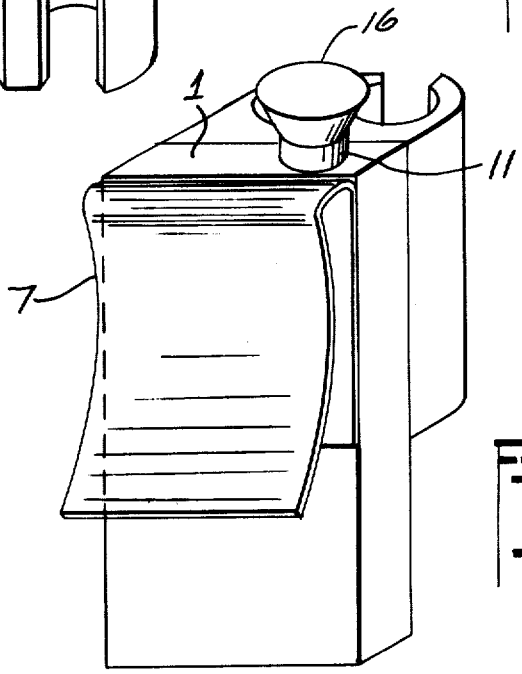

FIGS. 5, 7 and 8 show a metal clip 7 which is fastened to the body 1 of the invention by screws 18. First and most obvious, the clip 7 is used to fasten the invention onto a golfer's belt or golf bag as he desires. This is the standard use for such a device. The second and more important use for the metal clip 7 is used as a tuning fork or sounding mechanism to amplify the sound of the impact of the two striking surfaces 11 and 12. Clip 7 is shaped in such a way that a large area is suspended in air and is free to vibrate upon impact of the striking surfaces as mentioned earlier. The size of the free area and the elastic resonance qualities of the metal clip make this type of clip a very effective amplifier of sound. The value of this application will be to enable the device of the invention to be made much smaller or the sound of the impact to be increased as the golfer desires. This amplification of the sound of impact will permit the manufacture of two devices. One for the general public that will be very small and convenient and another that is slightly larger in order to increase the sound for the golfers who are hard of hearing. Now, it is understood that the metal clip 7 may be made of any material that will produce a good amplification of the sound of impact of the two striking surfaces. Steel or other materials with high Youngs Modulus values would seem to be the first choice for the clip material.

I claim:

1. A device for indicating the velocity of shaft-type athletic equipment such as a golf club, baseball bat, tennis racket and the like comprising an elongate body having a first bore extending longitudinally therethrough, a plunger movably disposed in said bore, said plunger being rod-like in general configuration and having an enlarged portion intermediate its ends, one end of said plunger projecting outwardly from said one end of said bore and having a cap formed thereon, a second bore formed in said body extending transversely to the first bore and opening into the latter, means movably disposed in said second bore, spring means disposed in said second bore having one end engaging said movable means, adjustment means disposed in said second bore having one end in engagement with the remaining end of the spring means effective to urge said movable means into pressure engagement with the plunger approximately adjacent one end of the enlarged portion remote from said plunger cap, means to detachably mount said body onto the shaft of the athletic equipment, said shaft being adapted to be swung by the player of sufficient velocity and power effective to cause said plunger to overcome the pressure of said spring means and then rapidly move in a striking direction through said bore, said enlarged portion on said plunger being of such configuration to effect a reversal of force acting on said plunger by the spring means and said movable means whereby said reversal of force assists or accelerates the movement of the plunger in said striking direction such that the cap strikes said elongate body with sufficient force to emit an audible sound or click.

2. A device as defined in claim 1 and wherein a tube is disposed in said first named bore and said plunger is movably disposed in said tube whereby as the plunger moves in its striking direction the cap strikes the adjacent end of said tube.

3. A device as defined in claim 1 and wherein the enlarged portion on said plunger is bulbous like in configuration.

4. A device as defined in claim 1 and wherein the movable means is a ball disposed in the second bore.

5. A device as defined in claim 2 and wherein a bearing surface is disposed on said plunger adjacent each side of the enlarged portion of said plunger and of sufficient lateral dimension to slidably engage the wall of said tube.

6. A device as defined in claim 1 and wherein the means to detachably mount said device to the athletic equipment comprises clamp means carried on the body of said device and releasably attachable to said equipment.

7. A device for indicating the velocity of shaft-type athletic equipment such as a golf club, baseball bat, tennis racket and the like comprising an elongate body having a first bore extending longitudinally therethrough, a metal tube disposed in said bore and having one end projecting outwardly from one end of said bore, a plunger movably disposed in said tube, said plunger being rod-like in general configuration, the outer surface being in inwardly spaced relation to the wall of the tube and having a bulbous portion intermediate its ends, a bearing surface disposed on opposite sides of said bulbous portion being of sufficient lateral dimension relative to the axis of the plunger to slidably engage the wall of said tube as said plunger moves therethrough, one end of said plunger projecting outwardly from said one end of said tube and having a cap formed thereon, a second bore formed in said body extending transversely to the first bore and opening into the latter, a ball disposed in said second bore, spring means disposed in said second bore having one end engaging said ball, adjustment means disposed in said second bore having one end in engagement with the remaining end of the spring means effective to urge the ball into pressure engagement with the plunger approximately adjacent the end of the bulbous portion remote from said plunger cap, means to detachably mount said body onto the shaft of the athletic equipment, said shaft being adapted to be swung by the player in normal manner and if said swing has sufficient velocity and power the plunger tends to move through said bore against the pressure exerted thereon by said ball until the pressure of said spring means is overcome to permit said plunger to then rapidly move in a striking direction through said bore, said bulbous portion being of such configuration to effect a reversal of force acting on said plunger by the spring means and ball whereby said reversal of force assists or accelerates the movement of the plunger in said striking direction such that the cap strikes the projecting end of the tube with sufficient force to emit an audible sound or click.

8. A device as defined in claim 1 and wherein means associated with said plunger is operable to amplify the audible sound or click.

9. A device as defined in claim 7 and wherein means associated with said plunger is operable to amplify the audible sound or click.

* * * * *